US009487323B2

(12) United States Patent
Yamamura

(10) Patent No.: US 9,487,323 B2
(45) Date of Patent: Nov. 8, 2016

(54) PACKAGING BOX

(71) Applicant: KYOCERA Document Solutions Inc., Osaka (JP)

(72) Inventor: Kazuyoshi Yamamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/694,201

(22) Filed: Apr. 23, 2015

(65) Prior Publication Data

US 2015/0307227 A1 Oct. 29, 2015

(30) Foreign Application Priority Data

Apr. 28, 2014 (JP) ..... 2014-092280

(51) Int. Cl.

| | |
|---|---|
| ***B65D 5/66*** | (2006.01) |
| ***B65D 5/468*** | (2006.01) |
| ***B65D 5/16*** | (2006.01) |
| ***B65D 5/02*** | (2006.01) |
| ***B65D 5/42*** | (2006.01) |

(52) U.S. Cl.

CPC ..... *B65D 5/6614* (2013.01); *B65D 5/0227* (2013.01); *B65D 5/16* (2013.01); *B65D 5/42* (2013.01); *B65D 5/4608* (2013.01)

(58) Field of Classification Search

CPC .... B65D 5/6614; B65D 5/0227; B65D 5/16; B65D 5/4608; B65D 5/6676

USPC ..... 229/117.16, 117.17, 117.13, 165, 125, 229/117.15, 122, 125.39, 149, 154

See application file for complete search history.

(56) References Cited

U.S. PATENT DOCUMENTS 2,947,462 A * 8/1960 Bostock ..... B65D 5/448 229/117.16

3,933,300 A * 1/1976 Dempster ..... B65D 5/18 229/117.17

FOREIGN PATENT DOCUMENTS

JP 2001-335021 A 12/2001

* cited by examiner

*Primary Examiner* — Christopher Demeree

(74) *Attorney, Agent, or Firm* — Studebaker & Brackett PC

(57) ABSTRACT

A packaging box where a body part has a bottom plate, first side plates erecting from one opposed edges of the bottom plate and second side plates erecting from other opposed edges and is provided with an opened upper surface. A pair of inner flaps are connected to upper edges of the first side plates through fold lines and folded inside. A pair of outer flaps are connected to upper edges of the second side plates through fold lines, and folded inside and overlapped with the pair of inner flaps to close the opened upper surface. Each of the pair of inner flaps is provided with a first engaging part. Each of the first side plates is provided with a first engaged part, which may engage with the corresponding first engaging part when the pair of inner flaps are folded and overlapped with the outsides of the first side plates.

5 Claims, 5 Drawing Sheets

Relatd Art

Relatd Art

PACKAGING BOX

INCORPORATION BY REFERENCE

This application is based on and claims the benefit of priority from Japanese Patent application No. 2014-092280 filed on Apr. 28, 2014, the entire contents of which are incorporated herein by reference.

BACKGROUND

The present disclosure relates to a packaging box for protecting a packaged article during its conveyance, storage and others.

A type A packaging box formed of a packaging material such as a cardboard is often used in carrying or storing an image forming apparatus, such as a printer, a copying machine, a facsimile, a multifunctional peripheral or the like, or components composing the image forming apparatus. As shown in FIG. 5A and FIG. 5B, the type A packaging box is a box formed such that an opening of a box-like body part 100 is opened/closed by a plurality of folding flaps 101. This type of box is widely used because it is relatively inexpensive.

The packaging material is selected for such packaging box in accordance to a weight of the packaged article, and a packaging material of a sufficient high strength is used in packaging or loading a heavy article such as the image forming apparatus. In a case where the high strength packaging material is used, when the flaps are opened to unpack the box, the flaps 101 may be kept substantially upright as shown in FIG. 5A or the flaps 101 may fold downward inside by itself, disabling to completely open the opening. If a work for taking in/out the packaged article in the state in which the flaps 101 are kept substantially upright is carried out, since a vertical distance to the packaged article stored in the body part 100 becomes longer by a length of the flap, it becomes hard to reach the packaged article, making it difficult to carry out the taking in/out the packaged article. Still further, even if the flaps 101 is creased to be folded outside, the flaps 101 often turn substantially only into a horizontal posture as shown in FIG. 5B because of its strong spring-back property. In this case, a horizontal distance to the packaged article becomes longer by the length of the flap 101. This problem is remarkable in case of a packaging box packaging a large packaged article such as the image forming apparatus.

To that end, there is a method of taking out the packaged article while keeping the flaps in an opened state by folding the flaps on an outside of the body part, opening an upper end portion of a wrapping material wrapping the packaged article and then covering the outside of the flaps with the wrapping material.

However, this article taking-out method is supposed to use the wrapping material and is unable to deal with a case when no wrapping material is used for the packaged article. Still further, it is necessary to adjust a shape and size of the wrapping material with those of the body part and a large-scale work of opening and covering the wrapping material over the folded flap is required.

SUMMARY

In accordance with an embodiment of the present disclosure, a packaging box includes a body part, a pair of inner flaps and a pair of outer flaps. The body part has a rectangular bottom plate, first side plates erecting from one opposed edges of the bottom plate and second side plates erecting from other opposed edges and is provided with an opened upper surface. The pair of inner flaps are connected to upper edges of the first side plates through fold lines and folded inside. The pair of outer flaps connected to upper edges of the second side plates through fold lines, and folded inside and overlapped with the pair of inner flaps to close the opened upper surface. Each of the pair of inner flaps is provided with a first engaging part. Each of the first side plates is provided with a first engaged part capable of being engaged with the corresponding first engaging part when the pair of inner flaps are folded and overlapped with the outsides of the first side plates. The first engaged part is a hand hole and the first engaging part is an insertion piece inserted into the hand hole.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1A:
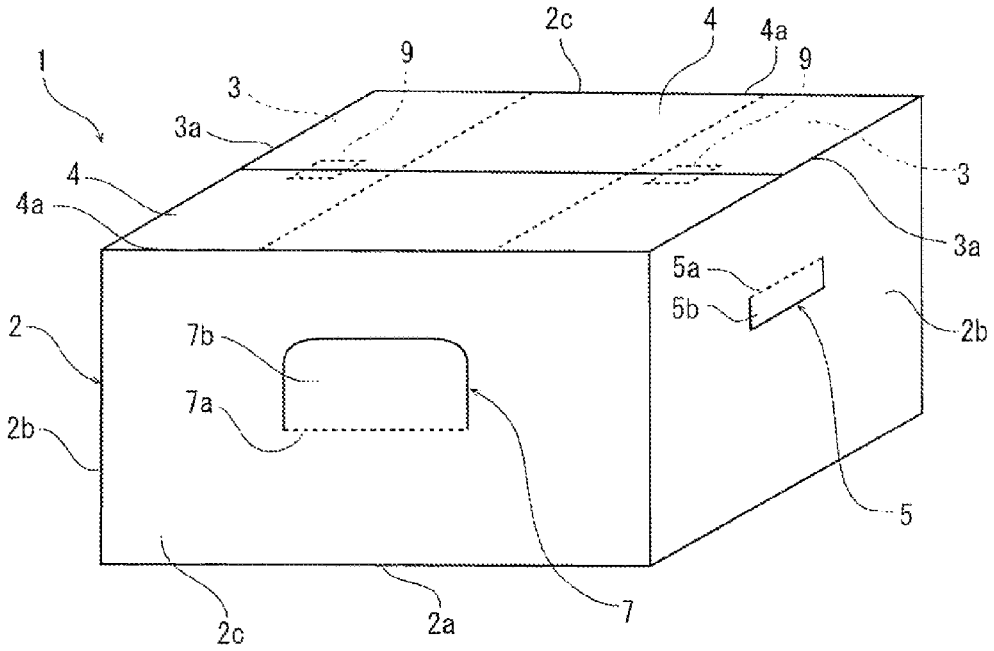
FIG. 1A is a perspective view showing a packaging box with an opening closed, according to one embodiment of the present disclosure.
Figure 1B:
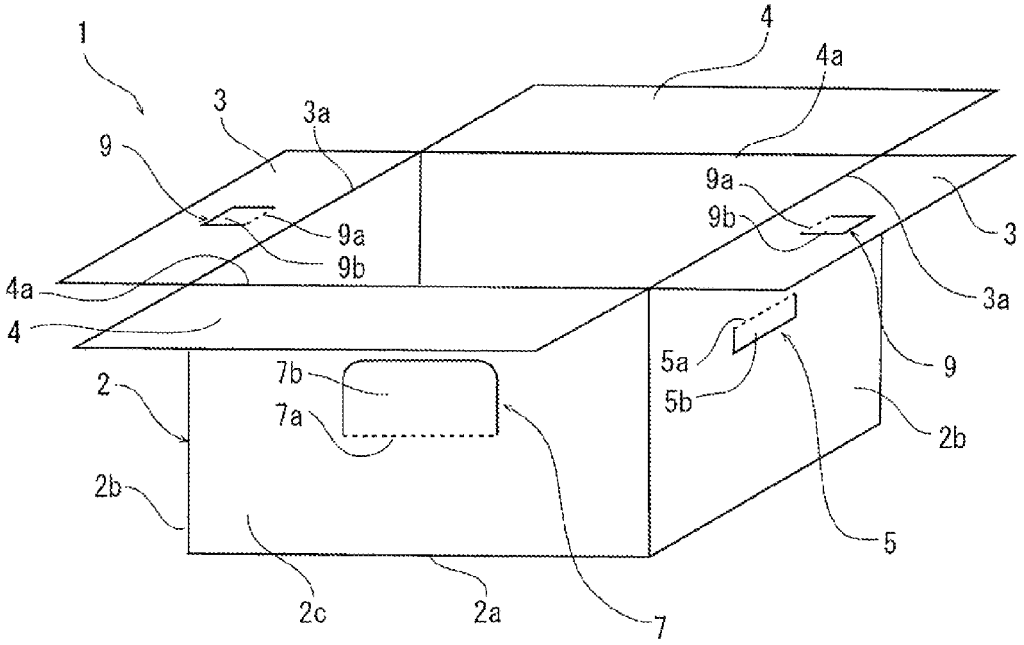
FIG. 1B is a perspective view showing the packaging box with the opening opened, according to the embodiment of the present disclosure.
Figure 2:
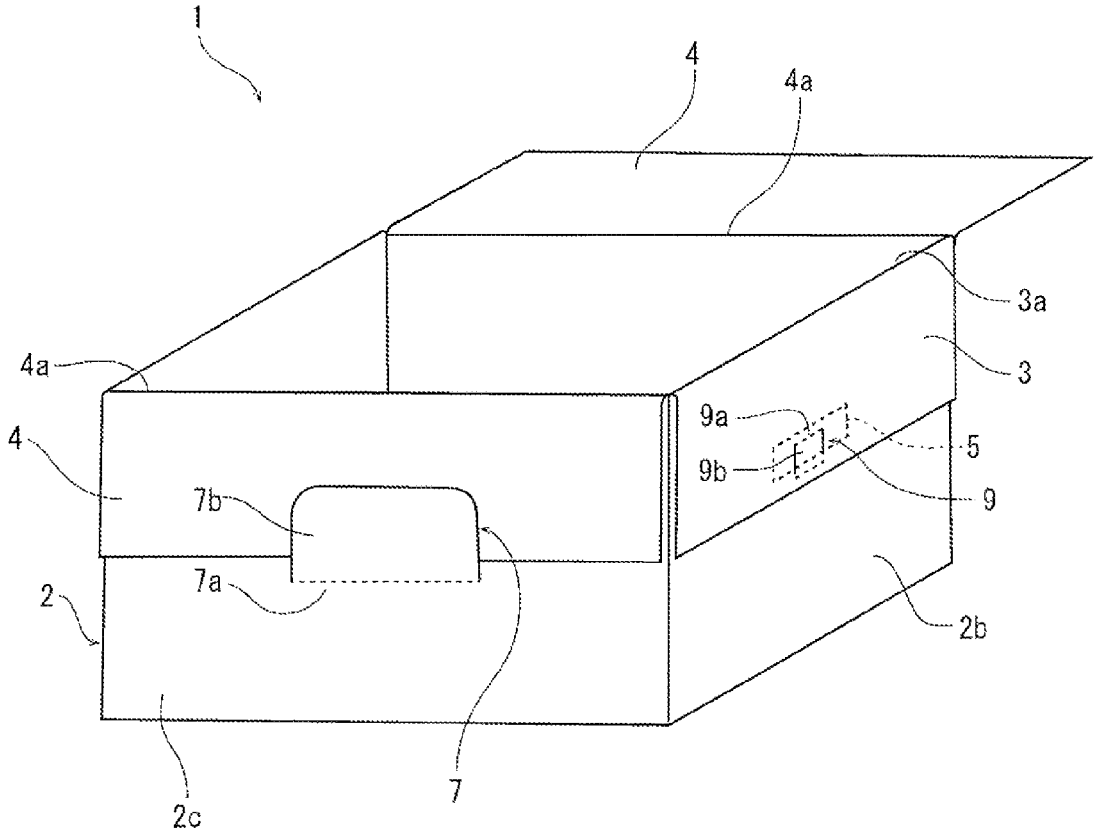
FIG. 2 is a perspective view showing the packaging box with inner flaps and outer flaps immovably engaged with first side plates and second side plate respectively, according to the embodiment of the present disclosure.
Figure 3A:
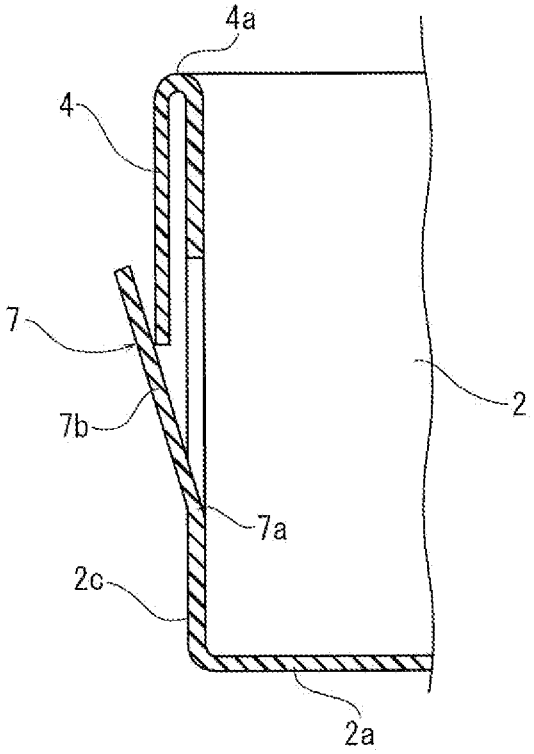
FIG. 3A is a side sectional view showing the packaging box with the outer flap immovably engaged with the second side plate, according to the embodiment of the present disclosure.
Figure 3B:
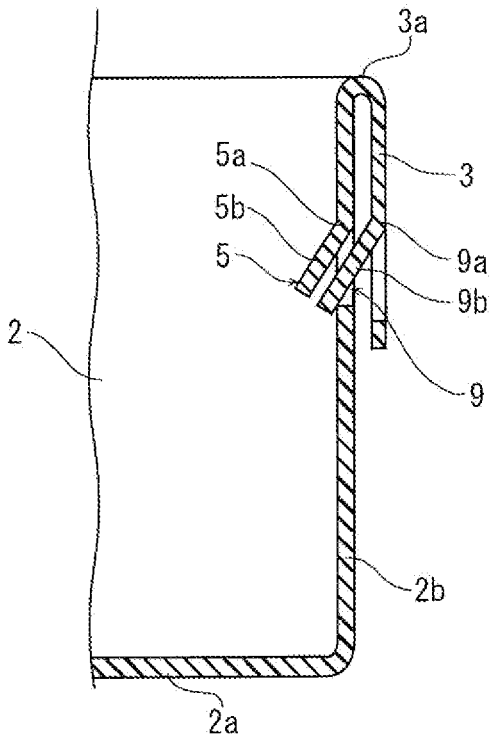
FIG. 3B is a side sectional view showing the packaging box with the inner flap immovably engaged with the first side plate, in according to the embodiment of the present disclosure.

A packaging box of one embodiment of the present disclosure will be described with reference to FIGS. 1 through 3. FIG. 1A is a perspective view showing a packaging box with an opening closed; FIG. 1B is a perspective view showing the packaging box with the opening opened; FIG. 2 is a perspective view showing the packaging box with inner flaps and outer flaps immovably engaged with first side plates and second side plate respectively; FIG. 3A is a side sectional view showing the packaging box with the outer flap immovably engaged with the second side plate; and FIG. 3B is a side sectional view showing the packaging box with the inner flap immovably engaged with the first side plate. It is noted that vertical and horizontal directions of the follow description denote vertical and horizontal directions in each figure.

As shown in FIGS. 1 and 2, the packaging box 1 includes a body part 2 provided with an opening at an upper surface, a pair of inner flaps 3 and a pair of outer flaps 4 closing the opening. The packaging box 1 is formed of a high strength packaging material such as a cardboard.

The body part 2 has a rectangular parallelepiped box-like shape having a rectangular bottom plate 2*a*, a pair of first side plates 2*b* erecting from short side edges of the bottom plate 2*a*, and a pair of second side plates 2*c* erecting from long side edges of the bottom plate 2*a*.

Each of the pair of first side plates 2*b* has a horizontally long rectangular shape and is formed with a carrying hand hole 5 (first engaged part) around a center in the vertical and horizontal directions. The hand hole 5 is formed by a horizontally long rectangular cut piece 5*b* folded upward along a fold line 5*a* extending in the horizontal direction. By folding the cut piece 5*b* inside or outside along the fold line 5*a*, a hand can insert through the carrying hand hole 5.

One side plate 2*c* of the pair of second side plates 2*c* is formed with a door 7 (second engaged part) dedicated for adding an enclosed item around a center in the vertical and horizontal directions. The enclosed item includes a document, a component part or the like, prepared exclusively in accordance to a specification of a packaged article for a foreign country, for example. Such the enclosed items can be enclosed through the dedicated door 7 without opening the packaging box 1. The dedicated door 7 is formed of a horizontally long rectangular cut piece 7*b* folded downward along a fold line 7*a* extending in the horizontal direction. Corners between both side edges and an end edge of the cut piece 7*b* are curved into a circular arc. By folding the cut piece 7*b* inside or outside along the fold line 7*a*, an opening through which the enclosed item can be stored in the body part 2 is formed through the second side plate 2*c*.

The pair of inner flaps 3 are connected to upper edges of the pair of first side plates 2*b* through fold lines 3*a*. Each inner flap 3 is provided with an insertion piece 9 (first engaging part). The insertion piece 9 is configured to correspond to the hand hole 5 formed on the first side plate 2*b* in a condition in which the inner flaps 3 are folded and overlapped with the outsides of the first side plates 2*b* along the fold lines 3*a*. The insertion piece 9 is a vertically long rectangular cut piece 9*b* folded inside (to the body part 2 side) along a fold line 9*a* in parallel with the fold line 3*a* of the first side plate 2*b*. The cut piece 9*b* has a height higher than that of the hand hole 5.

The pair of outer flaps 4 have an equal height with the pair of inner flaps 3. The pair of outer flaps 4 are connected to upper edges of the pair of second side plates 2*c*. When one of the outer flaps 4 is folded on the outside of the second side plate 2*c* along the fold line 4*a*, an outer edge of the outer flap 4 is located between a lower side edge and an upper side edge of the dedicated door 7.

In the packaging box 1 having the above-mentioned structure, when the opening of the body part 2 of the packaging box 1 is closed, the pair of inner flaps 3 are folded inside along the fold lines 3*a* and then the pair of outer flaps 4 are folded inside so as to overlap with the outsides of the pair of inner flaps 3.

When the opening of the body part 2 is opened, the dedicated door 7 is kept folded outside along the fold line 7*a* at first. Then, the outer flap 4 connected to the second side plate 2*c* on which the dedicated door 7 is provided is folded outside along the fold line 4*a* and overlaps with the outside of the second side plate 2*c* on the inside of the dedicated door 7 folded outside. When the dedicated door 7 is returned to its original posture, the outer flap 4 is immovably sandwiched between the second side plate 2*c* and the cut piece 7*b* of the dedicated door 7, as shown in FIG. 3A, on the outside of the second side plate 2*c*. It is noted that the other outer flap 4 is creased to fold outside by the fold line 4*a*.

Next, the pair of inner flaps 3 are folded outside along the fold lines 3*a* and are overlapped with the outsides of the first side plates 2*b*. Then, the cut pieces 9*b* are folded inside along the fold lines 9*a* and are inserted into the hand holes 5 formed on the first side plates 2*b*. Thereby, as shown in FIG. 3, the pair of inner flaps 3 are immovably engaged with the outsides of the first side plates 2*b*.

As described above, according to the packaging box 1 of the present embodiment, the pair of inner flaps 3 can be folded outward and immovably engaged with the first side plates 2*b* and one of the pair of outer flaps 4 can be also folded outward and immovably engaged with the second side plate 2*c*. Accordingly, if the other outer flap 4 is kept opened in a substantially upright or horizontal posture, the inner flaps 3 and the outer flaps 4 will not interfere a work for taking in/out the packaged article. Still further, in a case when two workers carry out the work face to face, if they stand on the outsides of the first side plates 2*b*, the packaged article can be taken in/out efficiently because the inner flap 3 will not interfere the work.

Still further, according to the present embodiment, because only forming the insertion pieces 9 on the pair of inner flaps 3 and positioning the dedicated door 7 so as to agree with the outer edge of the corresponding outer flap 4 are required, it is not necessary to use another separate member to engage the opened pair of inner flaps 3 with the first side plates 2*b* and, therefore, the structure of the packaging box 1 can be simplified. Still further, the insertion pieces 9 can be inserted into the hand holes 5 continuously after folding the inner flaps 3 outside and the outer flap 4 can be sandwiched between the cut piece 7*b* of the dedicated door 7 and the second side plate 2*c* continuously after folding the outer flaps 4 outside. Accordingly, the work for immovably engaging the inner flaps 3 and the outer flap 4 with the first side plates 2*b* and the second side plate 2*c* respectively can be facilitated.

Still further, because no insertion piece or the like is formed on the pair of outer flaps 4 overlapped with the outsides of the pair of inner flaps 3 when the opening of the body part 2 is closed by the pairs of inner and outer flaps 3 and 4, it is possible to prevent the insertion piece or the like from interfering in loading the packaging box 1 or from deteriorating appearance of the packaging box 1.

It is noted that if the packaging box 1 is not provided with the dedicated door 7, it is possible to carry out the work for taking in/out the packaged article efficiently even in a state in which the pair of inner flaps 3 are immovably engaged with the first side plates 2*b* and the pair of outer flaps 4 are folded in the substantially upright or horizontal posture.

While the insertion piece 9 formed on the inner flap 3 has a horizontally long rectangular shape in the present embodiment, the shape of the insertion piece 9 is not limited to such shape. FIGS. 4A through 4D illustrate modifications of the shape of the insertion piece 9.

Figure 4A:
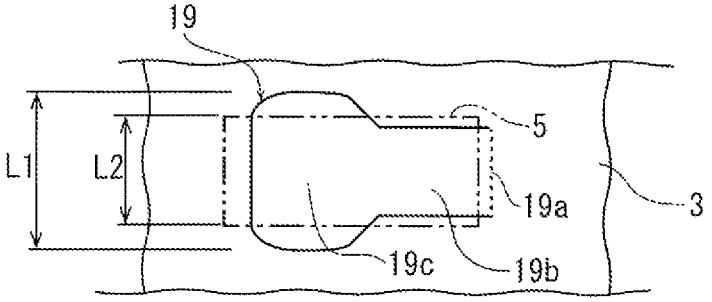
FIG. 4A is a plan view showing a first modified example of an insertion piece formed on the inner flap of the packaging box, according to the embodiment of the present disclosure.

An insertion piece 19 shown in FIG. 4A has a tang-like cut piece 19*b* folded along a fold line 19*a* extending in the vertical direction. The cut piece 19*b* is provided with a wide retaining part 19*c* at a tip end thereof. The retaining part 19*c* has a substantially vertically long rectangular shape. The retaining part 19*c* is formed so as to have a height L1 higher than a height L2 of the hand holes 5 of the first side plates 2*b*.

Figure 4B:
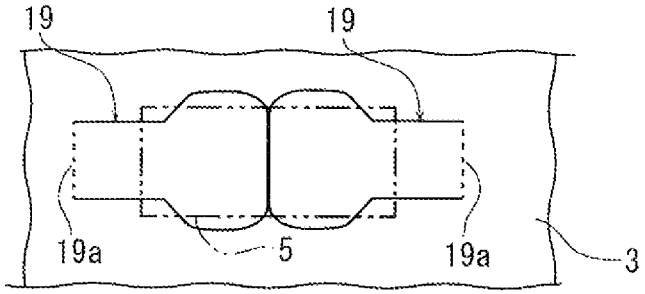
FIG. 4B is a plan view showing a second modified example of an insertion piece formed on the inner flap of the packaging box, according to the embodiment of the present disclosure.
Figure 4C:
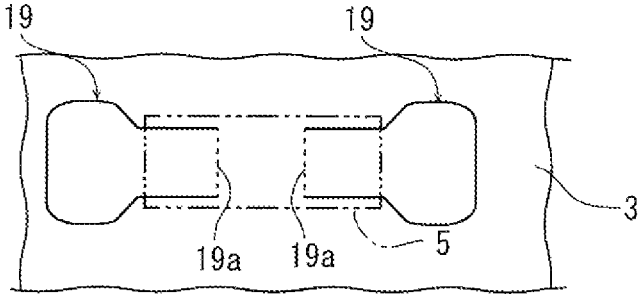
FIG. 4C is a plan view showing a third modified example of an insertion piece formed on the inner flap of the packaging box, according to the embodiment of the present disclosure.

Still further, the inner flap 3 may have two insertion pieces 19 disposed substantially symmetrically in the horizontal direction with the fold lines 19*a* outside, as shown in FIG. 4B, or substantially symmetrically in the horizontal direction with the fold lines 19*a* inside, as shown in FIG. 4C.

Figure 4D:
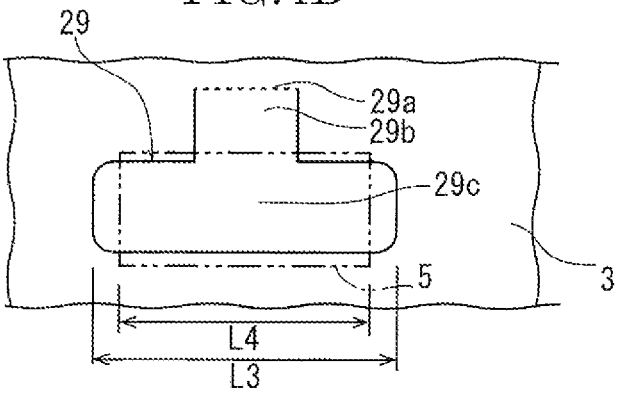
FIG. 4D is a plan view showing a forth modified example of an insertion piece formed on the inner flap of the packaging box, according to the embodiment of the present disclosure.
Figure 5A:
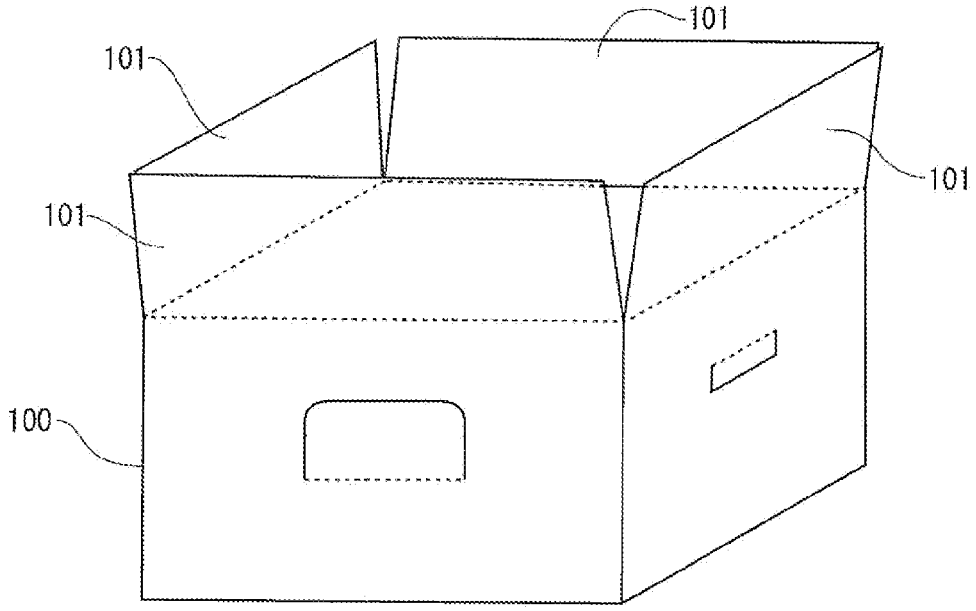
FIG. 5A is a perspective view showing a conventional packaging box with the opening opened.
Figure 5B:
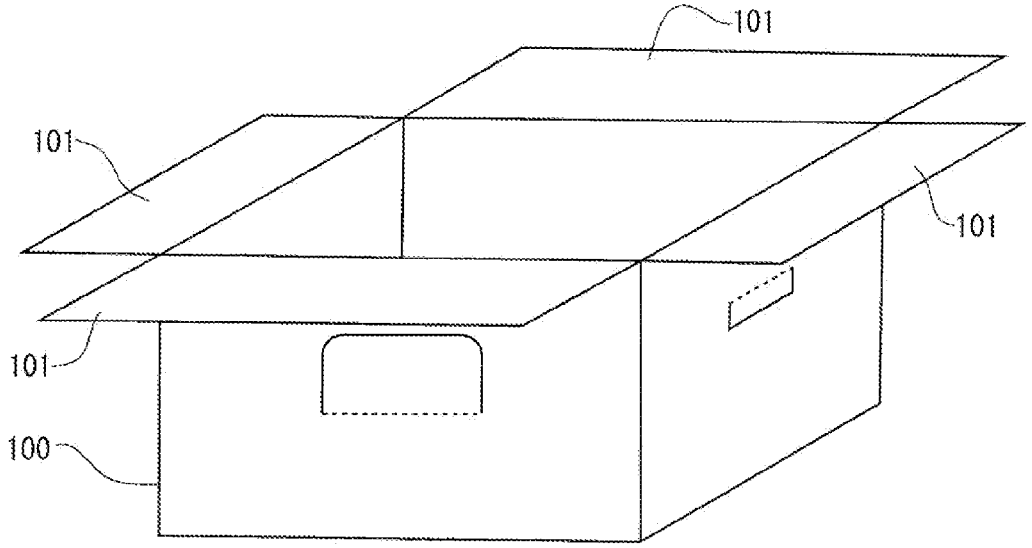
FIG. 5B is a perspective view showing the conventional packaging box with the opening opened.

An insertion piece shown in FIG. 4D has a tang-like cut piece 29*b* folded upward along a fold line 29*a* extending in the horizontal direction. The cut piece 29*b* is provided with a wide retaining piece 29*c* formed at a tip end thereof. The retaining part 29*c* has a horizontally long substantially rectangular shape. The retaining part 29*c* is formed so as to have a width L3 wider than a width L4 of the hand hole 5 of the first side plate 2*b*.

In the insertion pieces 19 and 29 having the above-mentioned structures, the retaining parts 19*c* and 29*c* are bended so as to narrow the width and then inserted into the corresponding hand hole 5. Then, after releasing the force bending the retaining parts 19*a* and 29*a*, the retaining parts 19*c* and 29*c* return to their original shapes to be retained by the corresponding hand holes 5. Accordingly, it is possible to more steadily engage the pair of inner flaps 3 with the first side plates 2*b*. It is noted that in the case of the embodiment illustrated in FIG. 4C, the two insertion pieces 19 are erected along the fold lines 19*a* and then inserted into the hand hole 5 substantially in the vertical direction.

By forming the retaining parts 19*c* and 29*c* on the insertion pieces 19 and 29, the work for taking in/out the packaged article can be carried out safety because the inner flaps 3 will not open during the working, especially when the work requires a long period of time or when the packaging box 1 is formed of the high strength packaging material. Still further, by providing two insertion pieces 19 as shown in FIGS. 4B and 4C, the inner flaps 3 can be immovably engaged with the first side plates 2*b* more steadily.

Still further, according to the embodiments shown in FIGS. 4A, 4B and 4C, the insertion piece 19 is folded along the fold line 19*a* extending in the vertical direction intersecting with the fold line 3*a* of the inner flap 3. Accordingly, even if the insertion piece 19 is applied with a force in a direction of pulling out of the hand hole 5 in a case when a spring-back force of the inner flap 3 is strong, the insertion piece 19 will not be folded in a same direction with the inner flap 3 so that the pair of inner flaps 3 can be immovably engaged with the first side plates 2*b* more steadily.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A packaging box comprising:

a body part having a rectangular bottom plate, first side plates erecting from one opposed edges of the bottom plate and second side plates erecting from other opposed edges, and provided with an opened upper surface;

a pair of inner flaps connected to upper edges of the first side plates through fold lines and folded inside; and a pair of outer flaps connected to upper edges of the second side plates through fold lines, and folded inside and overlapped with the pair of inner flaps to close the opened upper surface;

wherein each of the pair of inner flaps is provided with a first engaging part and each of the first side plates is provided with a first engaged part capable of being engaged with the corresponding first engaging part when the pair of inner flaps are folded and overlapped with the outsides of the first side plates; and the second side plate is provided with a second engaged part capable of being engaged with the corresponding outer flap when the outer flap is folded and overlapped on outside of the second side plate; and wherein the first engaged part is a hand hole and the first engaging part is an insertion piece inserted into the hand hole, the second engaged part is formed of a cut piece folded downward along a fold line of the second side extending in the horizontal direction, and the outer flap is immovably sandwiched between the second side plate and the cut piece when the outer flap is folded and overlapped on outside of the second side plate.

2. The packaging box according to claim 1, wherein the second engaged part is a door dedicated for adding an enclosed item.

3. The packaging box according to claim 1, wherein the first engaging part has an insertion piece folded along the fold line extending in a direction intersecting with the fold line of the pair of inner flaps.

4. The packaging box according to claim 1, wherein the first engaging part has insertion pieces folded along fold the lines extending in a direction intersecting with the fold lines of the pair of inner flaps.

5. The packaging box according to claim 1, wherein the insertion piece has a tang-like cut piece folded along a fold line, the insertion piece is provided with a wide retaining part formed at a front end thereof, and a width of the insertion piece is formed to be smaller than a height or a width of the hand hole and a width of the retaining part is formed to be larger than a height or a width of the hand hole.

* * * * *